United States Patent [19]

Sartor et al.

[11] Patent Number: 4,885,850

[45] Date of Patent: Dec. 12, 1989

[54] CLOSURE AND SECURING DEVICE, PARTICULARLY FOR SKI BOOTS

[75] Inventors: Mariano Sartor, Montebelluna; Mario Gonella, Spinea, both of Italy

[73] Assignee: Nordica S.P.A., Montebelluna, Italy

[21] Appl. No.: 173,216

[22] Filed: Mar. 25, 1988

[30] Foreign Application Priority Data

Apr. 2, 1987 [IT] Italy ..... 82531 A/87
Jun. 2, 1987 [IT] Italy ..... 82556 A/87

[51] Int. Cl.[4] ..... A43B 5/04; A43C 11/00
[52] U.S. Cl. ..... 36/119; 36/50
[58] Field of Search ..... 36/117-121, 36/50

[56] References Cited

U.S. PATENT DOCUMENTS

| | | | |
|---|---|---|---|
| 4,160,332 | 7/1979 | Salomon | 36/119 |
| 4,422,248 | 12/1983 | Bataille et al. | 36/121 |
| 4,765,069 | 8/1988 | Baggio et al. | 36/117 |

FOREIGN PATENT DOCUMENTS

| | | | |
|---|---|---|---|
| 188818 | 7/1986 | European Pat. Off. | 36/119 |
| 2018704 | 10/1971 | Fed. Rep. of Germany | 36/120 |
| 2266468 | 10/1975 | France | 36/117 |

*Primary Examiner*—James Kee Chi
*Attorney, Agent, or Firm*—Guido Modiano; Albert Josif

[57] ABSTRACT

A closure and securing device, particularly usable for ski boots comprising a rear quarter rearwardly having a transverse set of teeth with which there interacts a rod-like element embracing said rear quarter. Said rod-like element is operatively connected to one or more pressers placed at the foot instep region and/or at the heel region.

23 Claims, 5 Drawing Sheets

CLOSURE AND SECURING DEVICE, PARTICULARLY FOR SKI BOOTS

BACKGROUND OF THE INVENTION

The present invention relates to a closure and securing device, particularly for ski boots.

It is currently known to use, in ski boots, devices adapted to allow the adjustment of the degree of closure of the quarters, or the adjustment of their inclination with respect to the shell.

Devices are known which are adapted to limit, during the flexing phase in skiing, the stroke of the front quarter with respect to the shell, and devices are also known which are adapted to allow the actuation of pressers internal to the shell to improve its fit and for the better transmission of the stresses from the foot to the boot.

Such known devices are, if present in combination, independent from one another, requiring separate adjustments and furthermore creating problems for their bulk and their location on the boot.

As a partial solution to these disadvantages, in U.S. patent application No. 07/078,986, filed on July 29, 1987 by the same Assignee, and assumed included herein as reference, an adjustment device is claimed comprising a rod-like element, pivoted to the shell proximate to the region of the tip of the boot, which embraced the rear quarter.

On this last there was furthermore present a set of teeth with which a pawl pivoted to said rod-like element interacted.

Though said device allowed to adjust the degree of closure of the quarters and their inclination, it limits its action to these single functions.

SUMMARY OF THE INVENTION

The aim of the invention is therefore to eliminate the disadvantages described above in known types, by providing a device which allows the optimum, rapid and easy closure of the boot as well as the simultaneous securing of the foot in its interior.

Within this aim, an important object is to provide a device which allows to achieve the preceding characteristic by means of a single actuation on the part of the skier.

Still another object is to provide a device which allows the skier to vary according to his own requirements the degree of securing of his foot inside the boot.

Another object is to provide a device which allows the skier to "memorize" the degree of securing of the foot once set without having to reset it every time he/her wears the ski-boot.

Still another object is to provide a device which allows the skier, in a rapid and simple manner, to open the quarters and simultaneously release his foot inside the boot.

Not least object is to provide a device which is structurally simple as well as reliable and safe in use.

This aim and the objects mentioned, as well as others which will become apparent hereinafter, are achieved by a closure and securing device, particularly for rear-entry ski boots comprising a rear quarter, rearwardly having a transverse set of teeth, and a front quarter, both pivoted to a shell, comprising a rod-like element embracing said rear quarter, external to said shell and having a locking-release element cooperating with said set of teeth, which is characterized in that said rod-like element is operatively connected to at least one foot presser internal to said shell.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
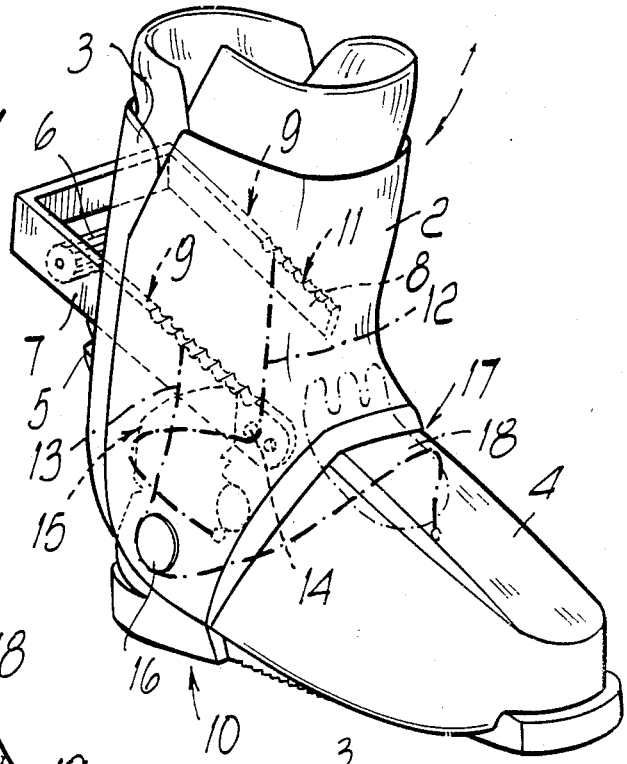
FIG. 1 is a perspective view of a boot with the device according to the invention.

With reference to the above described figures, the numeral 1 indicates a rear-entry ski boot constituted by a front quarter 2 and by a rear quarter 3 pivoted to a shell 4.

The rear quarter 3 rearwardly has a set of teeth 5, protruding transversely thereto, and interacting with a complementarily shaped roller 6 arranged transversely to a rod-like element 7 having an essentially U-shaped form. The element 7 embraces the rear quarter 3 and its flaps 8 are pivoted, at their free end, laterally to the shell 4 below the front quarter 2 or to the front quarter 2 above the shell 4.

The roller 6 constitutes a locking-release element associated with the rod-like element 7 and cooperating with the set of teeth 5.

At the flaps 8 of the rod-like element 7, at the surfaces 9 directed towards the opposite side with respect to the sole 10 of the boot, a plurality of notches 11 is provided with which a first and a second traction element, constituted respectively by a first cable 12 and by a second cable 13, are associable.

Said first cable 12, internal to the front quarter together with the flaps 8 of the rod-like element 7, is guided at a first guide element 14 rigidly associated with the rear quarter 3 and then transversely embraces a first presser 15 at the region of the heel of the skier's foot.

At the other end, said first cable 12 is then laterally retained to one of said quarters on the opposite side with respect to the guide element 14.

The second cable 13 is instead advantageously guided at the stud 16 for the pivoting of the quarters, and it affects the region 17 of the foot instep, thus interacting with an adapted presser 18 located thereat.

The free end of said second cable 13 is then retained laterally to the shell 4 on the opposite side with respect to the stud 16.

Figure 2:
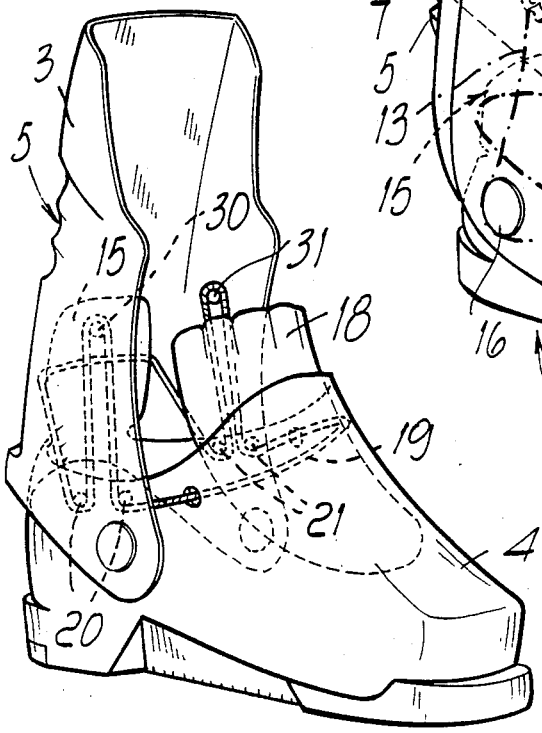
FIGS. 2 and 3 are schematic perspective views of two different arrangements of the cable.

Advantageously said first cable 12 and said second cable 13 can be merged into a single cable 19 which, as illustrated in FIG. 2, is guided laterally to the rear quarter 3 at a first and at a second pair of guide elements, indicated by the numerals 20 and 21, and then affects the first presser 15 and the second presser 18 embracing them. The pivots 30 and 31 are instead connected to the rod-like element 7 in a per se known manner or as described hereinafter.

Figure 3:
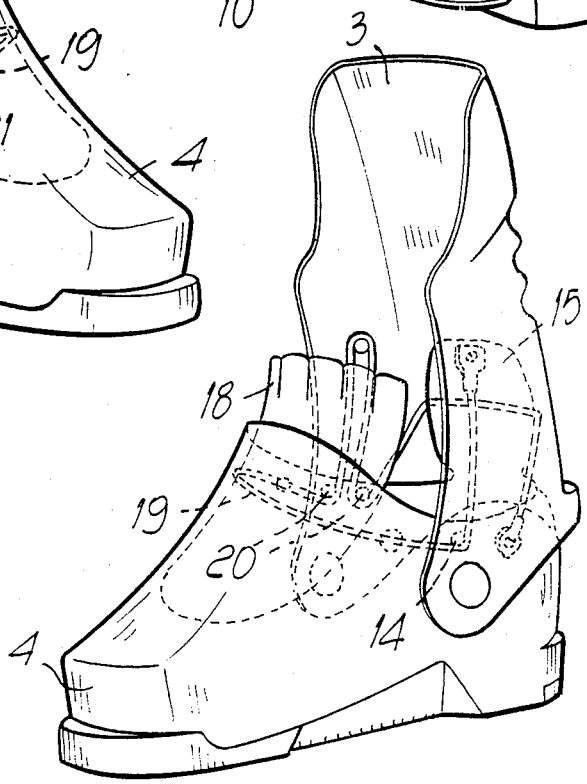

The cable 19 may be furthermore guided as illustrated in FIG. 3 in which an end thereof is associable at one of the flaps of the rod-like element, then guided at a first return element 14.

Subsequently the cable 19 embraces the second presser 18, is then guided at the first pair of guide elements 20 affecting the other flap of the rod-like element 7 and then embraces the first presser 15 being finally retained laterally to the rear quarter 3 at its free end.

Means for the temporary coupling to said flaps are associated at the portions of the cables 12 and/or 13 and/or of the one cable 19 interacting with the flaps of the rod-like element 7. Said means are constituted for example by a metallic element 22 shaped complementarily to the notches 11, to the latter there being retained on one side the cable and there protruding therefrom a tab 23, for the grip of the skier and therefore adapted to allow the skier to vary the positioning of said element 22 at the required notch 11.

Figure 5:
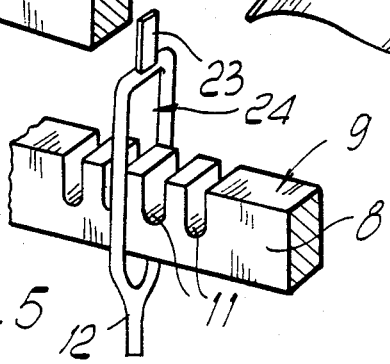

FIG. 5 illustrates a different solution in which for example the cable 12 splits to form an eyelet 24 through which the flap 8 of the rod-like element 7 is caused to pass, said eyelet being arrangeable at the required notch 11, the same also having a tab 23 for the grip of the skier.

Figure 6:
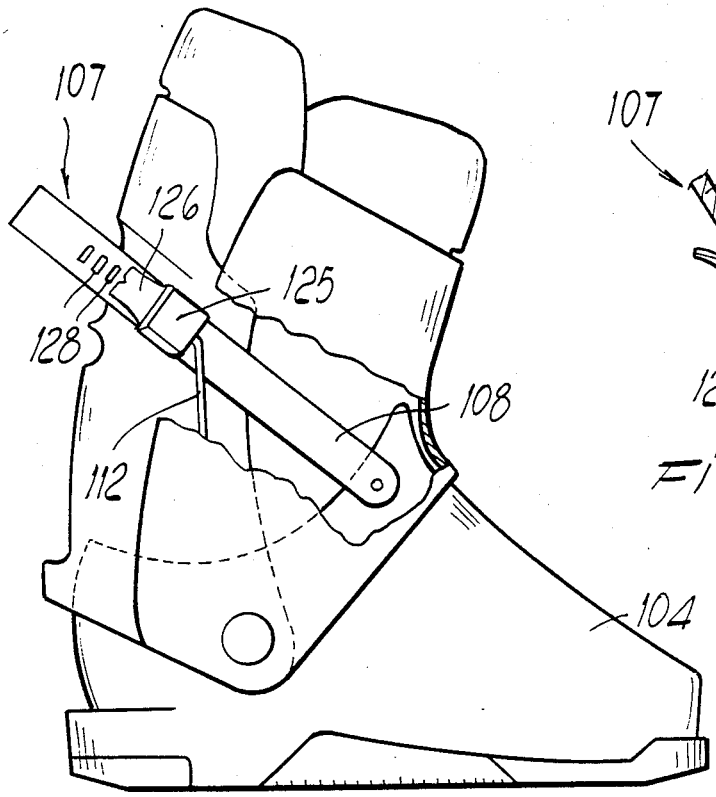
FIG. 6 is a partially cutout lateral elevation view, of a boot according to a second aspect of the invention.
Figure 7:
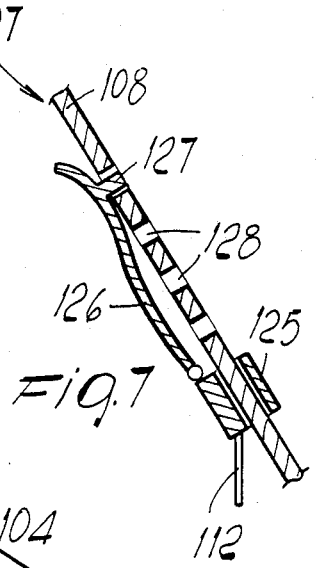
FIG. 7 is a view taken along a longitudinal cross section of the rod-like element of the boot of FIG. 6.
Figure 4:
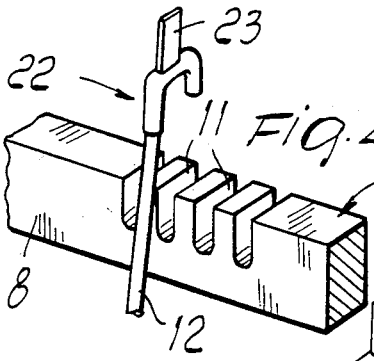
FIGS. 4 and 5 illustrate, in perspective views, the means adapted to allow the temporary coupling of said cable to the rod-like element.
Figure 8:
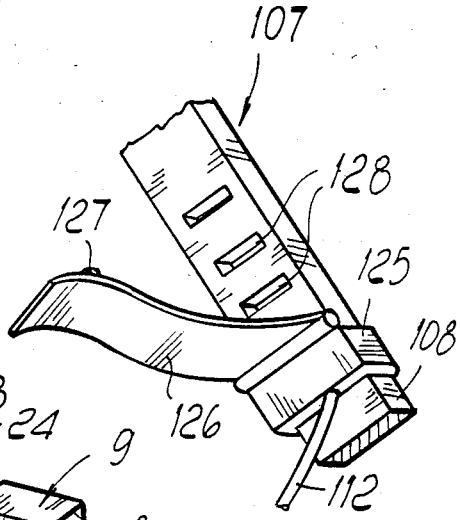
FIG. 8 is a perspective view of the means adapted to allow the temporary coupling of the cable to the rod-like element of the boot of FIG. 6.

FIGS. 6, 7 and 8 illustrate a device according to a second aspect of the invention in which with each of the flaps 108 of the rod-like element 107 there is slideably associated a slider 125 to an end whereof, directed towards the shell 104, the end of a traction element, constituted by a cable 112, is retained, with the other end of said slider there being instead associated a manually operatable lever 126, having a lug 127 protruding towards said flap 108 and locatable at adapted seats 128 provided longitudinally thereto.

Advantageously, the arrangement of said seats and of the slider will be such as to allow the adjustment of the degree of tensioning of the cable 112 always with the quarters closed, by actuating not the rod-like element directly but the lever 126. Furthermore, the lever 126 may be pivoted to the slider 125. The use of the device is therefore as follows: initially the skier adjusts the working length of the cables by positioning it at the selected notch provided on the flaps of the rod-like element.

Once this is done, it will be sufficient for the skier to perform a single maneuver to achieve the simultaneous closure of the quarters and the desired securing of the foot, this maneuver being constituted by the lifting of the rod-like element 7 causing the roller 6 to interact at the required set of teeth 5.

The release is just as rapid since, by lowering said rod-like element with the hand or with the other boot, the opening of the quarters and the release of the foot are simultaneously achieved.

Figure 9:
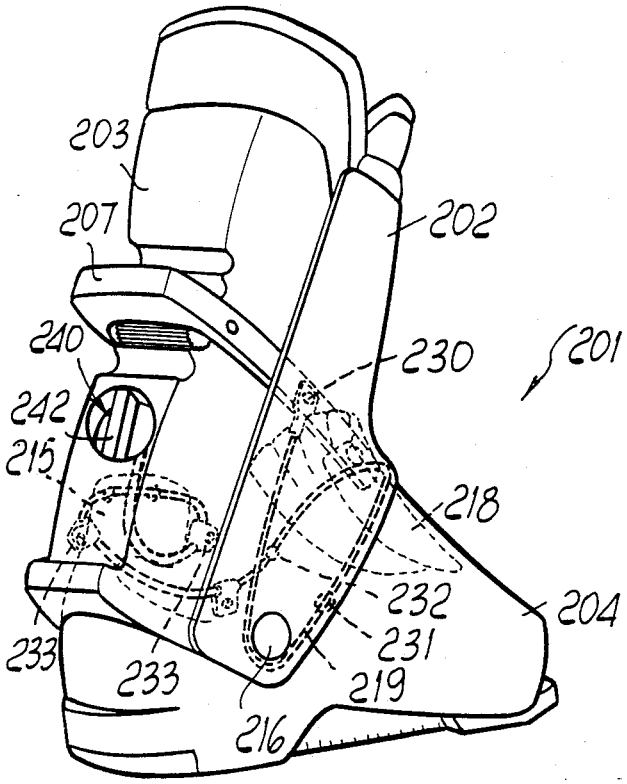
FIG. 9 is a perspective view of a boot according to a third aspect of the invention.

FIG. 9 illustrates a boot 201, according to a third aspect of the invention, comprising a shell 204 with which a front quarter 202 and a rear one 203 are associated.

A rod-like element 207 connects the quarters in a manner similar to what has been described above, and also similarly a cable 219 has a first end 230 associated with the rod-like element 207 at the inner side of the front quarter 202.

The cable 219 is furthermore guided on the pivot 216 and enters the shell 204 through a hole 231 embracing a foot instep presser 218; the cable 219 then exits through the hole 232 and embraces a heel presser 215 by means of the guide elements 233.

Figure 10:
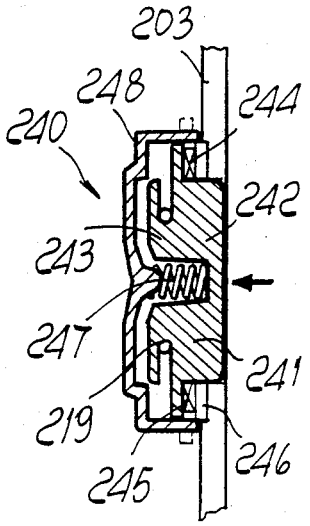
FIG. 10 is a longitudinal sectional view, in enlarged scale, of the adjustment device of the boot of FIG. 9.

The second end of the cable 219 is finally associated with a device 240 for the adjustment of its useful length; the device 240 is advantageously fixed to the rear quarter 203 and, as illustrated in FIG. 10, comprises a knob 241 having a grip 242 and a pulley 243 for winding the cable 219. The knob 241 furthermore has a set of teeth 244 adapted to engage with a similar set of teeth 245 carried by a cover 246 associated with the quarter 203. A spring 247 acts between a box 248 for the containment of the knob 241 and said knob to keep the sets of teeth 244 and 245 engaged, so as to prevent the rotation of the pulley 243 in the direction of unwinding of the cable 219. To slacken the cable 219 it is sufficient to press on the grip 242 of the knob 241, as indicated by the arrow in FIG. 10, and to rotate said knob; for winding the cable it is instead sufficient to rotate the knob in the opposite direction.

Figure 11:
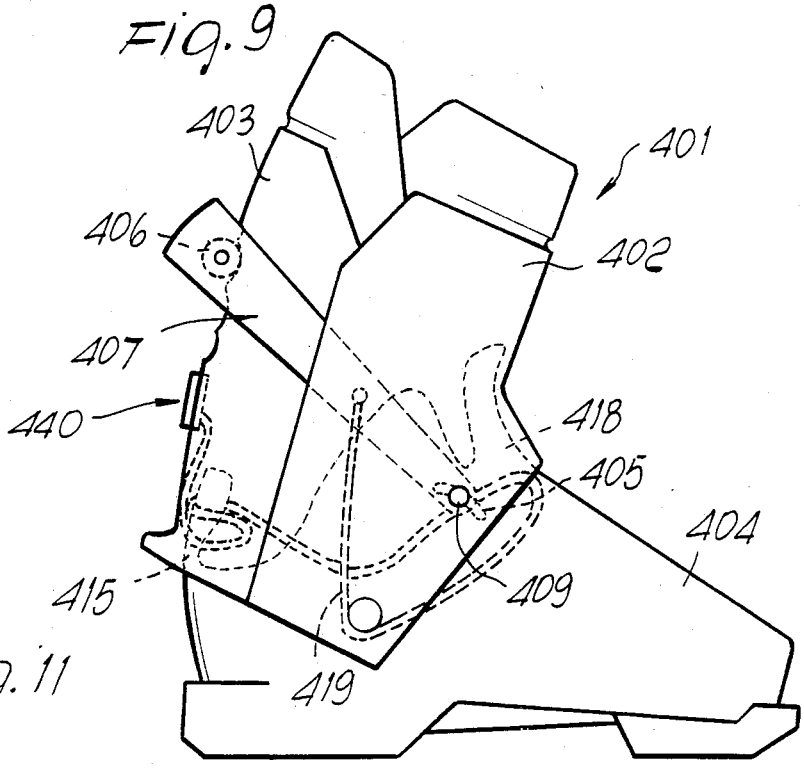
FIG. 11 is a lateral elevation view of a boot according to a fourth aspect of the invention.
Figure 13:
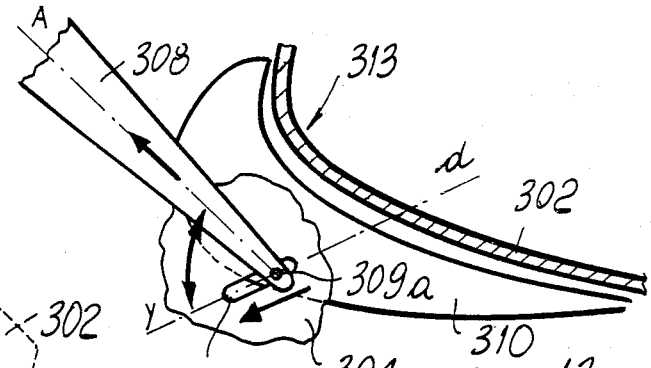
FIG. 13 is a view, partially in longitudinal cross section and in enlarged scale, of a detail of the boot of FIG. 12.
Figure 12:
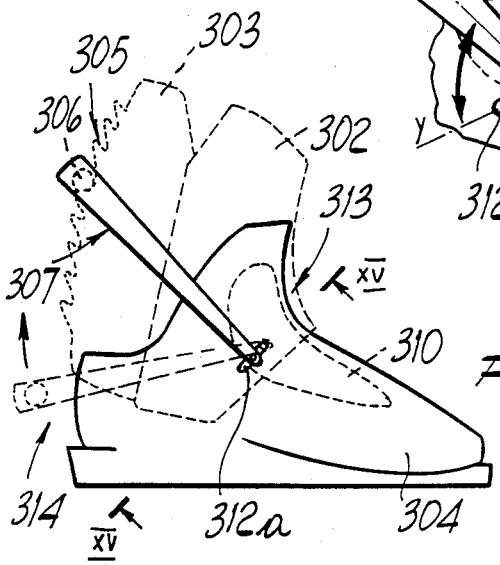
FIG. 12 is a lateral elevation view of a boot according to a fifth aspect of the invention.
Figure 15:
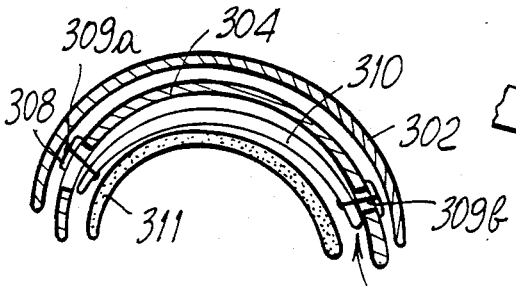
FIG. 15 is a sectional view along the line XV—XV of FIG. 12.
Figure 17:
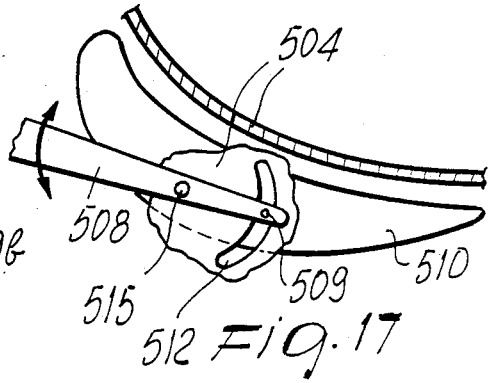
FIG. 17 is a view, similar to that of FIG. 13, related to the boot of FIG. 16.

FIG. 11 illustrates a boot 401 according to a further aspect of the invention, which has a rod-like element 407 connected both to the shell 404 and to the front quarter 402 in turn pivoted to said shell 404.

The shell 404 has an eyelet 405 so that the pivot 409 for connection between the front quarter 402 and the rod-like element 407 can slide thereat allowing an oscillation of the quarters 403 and 402 relatively to the shell 404.

A cable 419 is associated, at one of its ends, with the rod-like element 407 and embraces, internally to the boot, a foot instep presser 418 and a heel presser 415, in a manner fully similar to what has been described above. The free end of the cable 419 is furthermore associated with a device 440 for the adjustment of the useful length similar to the device 240 described above.

The device 240, 440 for the adjustment of the useful length of the cable allows a fine adjustment of the pressure exerted by the pressers on the foot; this adjustment can be performed with the foot already secured inside the boot and is in any case memorized so as to not force the skier to actuate the knob 240, 400 each time he puts the boot on.

With reference to FIGS. 12–17, the numeral 301 indicates a rear-entry ski boot, constituted by a front quarter 302 and by a rear quarter 303 pivoted to a shell 304.

Rearwardly and transversely to the rear quarter 303, a set of teeth 305 is provided, whereat there interacts a complementarily shaped roller 306 also arranged transversely to a rod-like element 307.

The element 307 has an essentially U-shaped form, and embraces the rear quarter 303 while its flaps 308 are arranged externally to the rear quarter 303 and internally to the front quarter 302.

At the terminal ends, each of the flaps 308 is articulated, by means of an adapted pair of rivets indicated at 309*a* and 309*b*, to a presser 310 placed internally to the shell 304 and overlying an adapted inner shoe 311.

Each of the rivets 309*a* and 309*b* has its stem accommodated and slideable within an adapted eyelet indicated at 312*a* and 312*b* and provided on the shell 304.

Each of the eyelets 312*a* and 312*b* is conveniently orientated so as to ensure the translatory motion of the presser 310 along the directrix which connects the regions 313 of the foot instep and 314 of the heel when the rod-like element 307 is raised for the mutual closure of the front quarter 302 and rear quarter 303.

For a correct operation, the angle Y formed between the directrix d of the eyelets with the axis A of the flaps 308 in closed position must be significantly smaller than 90°.

In said closure condition the presser 310 is pushed at the underlying foot, ensuring its optimum securing inside the boot.

The lifting of said presser for the extraction and/or the insertion of the foot is achieved by means of the pressure which the foot itself exerts if the rod-like element 307 is completely lowered, that is to say placed against the heel region 314.

Figure 14:
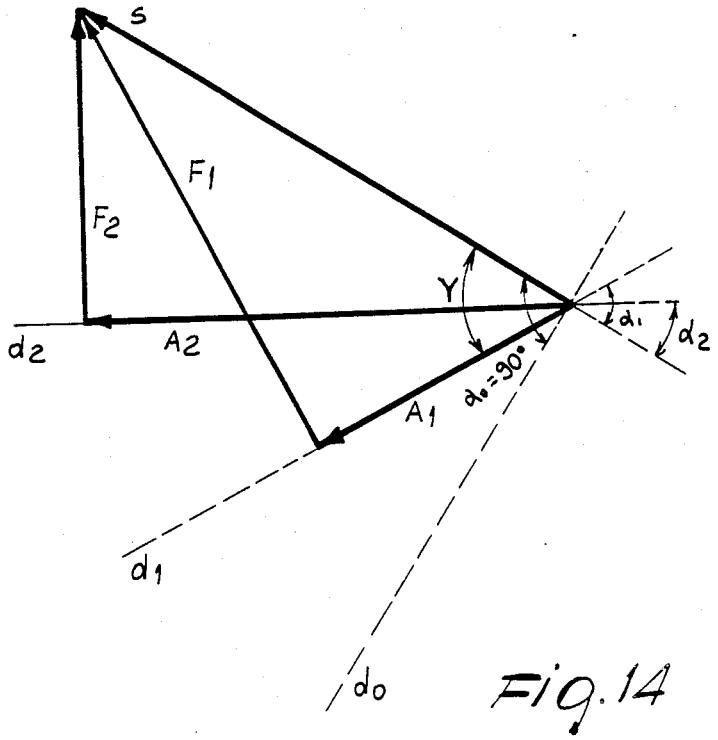
FIG. 14 is a graph illustrating the stresses applied to the pivoting point of the rod-like element of the boot of FIG. 12.

FIG. 14 illustrates a diagram in which the letter S indicates the closure effort of the rod-like element, A1 and A2 indicate the sliding efforts determined according to the orientation of the directrix d and F1 and F2 indicate the orthogonal components of said effort S.

From the graph it is deduced that, with an equal applied effort "S", different sliding efforts are obtained, according to the inclination of the directrix "d".

In particular it occurs that the smaller the angle Y is with respect to 90°, the more the sliding is facilitated.

In fact, with reference to the graph of FIG. 14, when the directrix of the axis of the eyelet coincides with $d_o$, the angle $\alpha_o$ measures 90° and the component F coincides with S: therefore no sliding along the eyelet occurs.

When the directrix of the axis of the eyelet corresponds to $d_1$, the angle $\alpha_1$ is smaller than 90° and the component $F_1$ is greater than $A_1$: a difficult translatory motion along the eyelet occurs.

Finally, with the axis of the eyelet corresponding to $d_2$, the angle $\alpha_2$ is smaller than the angle $\alpha$, and accordingly the component $F_2$ is smaller than $A_2$: in this case the sliding is facilitated and this condition is the most advantageous.

It has thus been observed that the invention achieves the intended aims and objects, a device having been obtained which allows, to achieve the closure and/or the opening of the boot and simultaneously the securing and/or the release of the foot in its interior by means of the single maneuver on the rod-like element 307 by means of, for example, the other boot.

In fact, the coupling of the flaps 308 to the inner presser 310 allows, by means of a per se simple structure, to achieve the optimum securing of the foot.

The shape and the arrangement of the eyelet 312 may naturally vary according to the requirements or to obtain a different securing method. For example, the eyelet 312 may be arranged substantially horizontally and may have a particular shape to guide the movement of the presser 310 when the rod-like element is locked.

Naturally the invention thus conceived is susceptible to numerous modifications and variations, all of which are within the scope of the same inventive concept.

Figure 16:
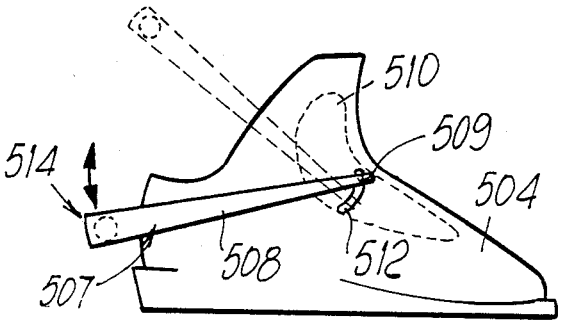
FIG. 16 is a view, similar to that of FIG. 12, of a boot according to a sixth aspect of the invention.

Thus, for example, FIG. 16 illustrates a device composed of a rod-like element 507 the flap 508 whereof is articulated at the end, by means of rivets 509 passing within an adapted eyelet 512 provided on the shell 504, to a presser 510 internal to said boot 504.

The flaps 508 of the rod-like element 507 are furthermore pivoted, proximate to the end articulated to the presser, externally to said shell 504 by means of adapted studs 515.

Advantageously the eyelets 512 have the shape of an arc of a circle with center in the pivoting point of said flaps 508 to said shell 504.

The studs 515 are furthermore positioned at such a distance from the rivets 509 as to allow the complete lowering of the rod-like element 507 down to proximate to the heel region 514 and the simultaneous lifting of the presser 510.

Figure 18:
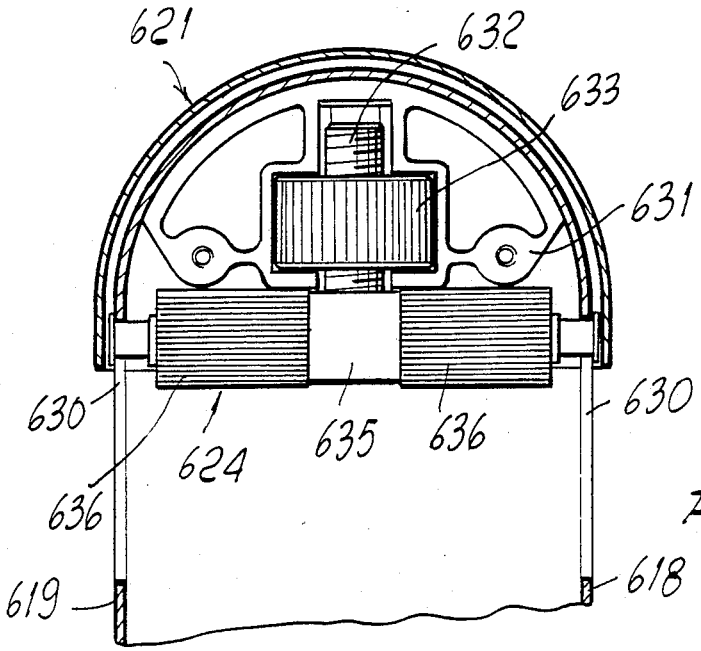
FIG. 18 is a partially sectional view of a system for the adjustment of the rod-like element.

FIG. 18 finally illustrates a device for the adjustment of the position of the roller 624 of the rod-like element, of which the flaps 618 and 619, at the ends whereof the adjustment block 621 supporting said roller 624 is fixed, are visible.

The block 621 has the frame 631 rotatably supporting a ring 633; the ring 633 engages a threaded bar 632 arranged parallel to the flaps 618 and 619 so that by rotating the ring 633 the rod 632 is moved in a direction parallel to the flaps 618, 619.

To the end of the bar 632 directed towards the quarter of the boot there is connected the roller 624 which is constituted by a supporting bar 635 for the rollers 636; the ends of the bar 635 are engaged in slots 630 provided longitudinally on the flaps 618, 619 so that by rotating the ring 633 the roller 624 is moved, adjusting its position and allowing therefore a fine adjustment of the degree of closure of the quarters.

Naturally the materials, as well as the dimensions of the individual components of the device, may be any according to the specific requirement.

We claim:

1. Closure and securing device, particularly for rear-entry ski boots, of the kind having a shell including a sole and a rear quarter, rearwardly having a transverse set of teeth, and a front quarter, both pivoted to said shell and further including at least one foot presser internal to said shell, the device comprising a rod-like element embracing said rear quarter external to said shell and having a locking-release element cooperating with said set of teeth, said rod-like element being operatively connected to said foot presser and having a U-shaped form and comprising two flaps articulated at their ends to said shell, wherein said rod-like element comprises supported on said flaps thereof a transverse roller facing and interacting with said transverse set of teeth and means for connecting said rod-like element with said foot presser.

2. Device according to claim 1, wherein said means for connecting said rod-like element with said at least one presser comprises a pair of rivets, said at least one presser being placed internally to said shell at the upper region of the foot of the skier and overlying an inner shoe.

3. Device according to claim 2, wherein each rivet of said pair of rivets has a stem accommodated and slideable within an adapted eyelet provided on said shell.

4. Device according to claim 1, wherein each rivet of said pair of rivets has a stem accomodated and slidable within an adapted eyelet provided on said shell and wherein said eyelet has a length and an orientation on said shell such as to allow the excursion of said at least one presser from a position of noninterference to one of active interference with said inner shoe respectively in the conditions of said rod-like element arranged proximate to the region of the heel of said boot and to the upper end of said rear quarter.

5. Device according to claim 4, wherein said eyelet is orientated along a directrix which approximately connects the regions of the instep of the foot and of the heel in the condition of closure of said quarters, or according to a substantially horizontal direction, and has a width greater than the diameter of said rivet.

6. Device according to claim 3, wherein the angle formed between the directrix of said eyelet with the axis of the flaps of said rod-like element in closure condition is smaller than 90°.

7. Device according to claim 1, wherein said means for connecting said rod-like element with said at least one presser comprises articulation means located proximately to the free ends of said flaps of said rod-like element, said rod-like element being furthermore pivoted externally to said shell by means of adapted studs.

8. Device according to claim 7, wherein said articulation means comprise a pair of eyelets having the shape of an arc of circle, with their center approximately in the pivoting point of said rod-like element with respects to said shell.

9. Device according to claim 1, wherein said rod-like element is articulated to said presser at eyelets having the shape of an arc of circle with their center approximately in the pivoting point of said rod-like element to said shell, said eyelets having such a length as to allow the excursion of said presser from a position of noninterference to one of active interference with said inner shoe respectively in the conditions of rod-like element arranged proximate to the region of the heel of said boot and to the upper end of said rear quarter.

10. Device according to claim 1, wherein said flaps have a portion partially hidden by said front quarter, said portion having a plurality of notches on a surface thereof facing away from said sole of said boot, said means for connecting said rod-like element with said at least one foot presser comprising at least one traction element, said plurality of notches being selectively associable with said at least one traction element connected to said presser.

11. Device according to claim 1, wherein on said flaps, partially hidden within said front quarter, at the surfaces directed towards the opposite side with respect to the sole of said boot, a plurality of notches is provided with which there is selectively associable at least one traction element connected to said presser and wherein said at least one traction element comprising a first cable and a second cable, both said cables having an end associable with one of said notches, said first cable being guided, internally and laterally to said rear quarter, to transversely embrace a first presser present at the heel region of the foot of the skier, at the other end said first cable being retained laterally to at least one of said front and rear quarters.

12. Device according to claim 11, wherein said second cable is guided, on the opposite side with respect to said first cable, at a stud for the pivoting of said front and rear quarters, said second cable affecting the region of the instep of the foot of the skier and interacting with a second presser located thereat, at the other end said second cable being laterally retained to said shell on the side opposite to said stud.

13. Device according to claim 1, wherein on said flaps, partially hidden within said front quarter, at the surfaces directed towards the opposite side with respect to the sole of said boot, a plurality of notches is provided with which there is selectively associable at least one traction element connected to said presser wherein said at least one traction element consists of a single cable selectively associable with one of said notches present on each of said flaps of said rod-like element, a first pair and a second pair of guide elements guiding said single cable laterally to said rear quarter, said single cable further embracing a first presser located at the heel region of the foot of the skier and a second presser located at the instep region of the foot of the skier.

14. Device according to claim 1, wherein on said flaps, partially hidden within said front quarter, at the surfaces directed towards the opposite side with respect to the sole of said boot, a plurality of notches is provided with which there is selectively associable at least one traction element connected to said presser and wherein said at least one traction element comprises a single cable having an end selectively associable at one of said notches present on said flaps of said rod-like element and a first pair of guide elements, said at least one presser comprising a first presser located at the heel region of the foot of the skier and a second presser located at the instep region of the foot of the skier, said single cable being guided around said pair of guide elements to embrace said second presser, then again returned at said first pair of guide elements, to affect the other of said flaps of said rod-like element, embracing said first presser to be retained at the other end laterally to said rear quarter.

15. Device according to claim 11, wherein said first and said second cable are associated with said notches by temporary coupling means, said temporary coupling means comprising a metallic element for each said first and second cable and shaped complementarily to said notches, to each said metallic element there being retained an end of one of said first and said second cables and there protruding therefrom a grip tab for the skier.

16. Device according to claim 1, wherein on said flaps, partially hidden internally to said front quarter, a plurality of notches is provided at the surfaces directed towards the opposite side with respect to the sole of said boot, with said notches there being selectively associable at least one traction element connected to said presser, said traction elements comprising a first and a second cable, both having an end associable with one of said notches, said first cable being guided, internally and laterally to said rear quarter, to transversely embrace a first presser present at the heel region of the foot of the skier, at the other end said first cable being retained laterally to at least one of said front and rear quarters and wherein the ends of said first and said second cables associable with said rod-like element are split to form an eyelet through which there passes one of said flaps of said rod-like element, said eyelet comprising a metallic element shaped complementarily to said notches to selectively engage therewith, to said element there being retained the end of said first and said second cables and there protruding therefrom a grip tab for the skier.

17. Device according to claim 1, wherein said means for connecting said rod-like element to said presser comprises a traction element and at least one slider slidably associated with said rod-like element, at one end of said slider, facing towards said shell, there being retained one end of said traction element, said slider having another end with which is associated a lever seizable by the skier.

18. Device according to claim 17, wherein said lever has a lug protruding in the direction of said flap and arrangeable at adapted seats provided longitudinally to said flap.

19. Device according to claim 1, wherein said means for connecting said rod-like element to said presser includes a traction element having a first end connected to said rod-like element and a second end connected to a device for the adjustment of its useful length.

20. Device according to claim 19, wherein said adjustment device is fixed to said rear quarter.

21. Device according to claim 1, wherein said rod-like element is pivoted to said front quarter by means of a pivot, said pivot being furthermore slideable in an eyelet provided in said shell, said rod-like element furthermore having a transverse roller facing said set of teeth provided on said rear quarter.

22. Device according to claim 1, wherein said foot presser includes a first foot presser located at the heel region of the skier's foot and a second foot presser located at the instep region of the skier's foot, said means for connecting said rod-like element to said first and said second pressers comprising a traction element having a first end connected to said rod-like element and a second end connected to a device for the adjustment of its useful length.

23. Device according to claim 1, wherein said locking-release element comprises a frame rigidly associated with said rod-like element and carrying a rotatable ring which is prevented to slide axially to said frame, said ring engaging with a threaded bar extending substantially parallel to said flaps of said rod-like element, said threaded bar being rigidly associated with a supporting bar extending substantially perpendicular to said flaps and rotatably supporting said roller, whereby a rotation of said ring causes a translatory motion of said supporting bar in a direction substantially perpendicular to said set of teeth of said rear quarter.

* * * * *